US005765266A

United States Patent [19]

Betz

[11] Patent Number: 5,765,266

[45] Date of Patent: Jun. 16, 1998

[54] SAFETY BELT DESIGNED FOR USE WITH A BELT PRETENSIONER

[75] Inventor: Hans-Peter Betz, Böbingen, Germany

[73] Assignee: TRW Occupant Restraint Systems GmbH, Alfdorf, Germany

[21] Appl. No.: 901,232

[22] Filed: Jul. 25, 1997

[30] Foreign Application Priority Data

Aug. 7, 1996 [DE] Germany ..... 296 13 690.5

[51] Int. Cl.[6] ..... A44B 11/26

[52] U.S. Cl. ..... 24/633; 24/642

[58] Field of Search ..... 24/633, 654, 640, 24/639, 641, 642; 297/468, 480

[56] References Cited

U.S. PATENT DOCUMENTS

| | | | |
|---|---|---|---|
| 5,029,369 | 7/1991 | Obergardt et al. | 24/633 |
| 5,213,365 | 5/1993 | Fohl | 24/633 X |
| 5,309,611 | 5/1994 | Wier et al. | 24/633 |
| 5,496,068 | 3/1996 | Ball et al. | 24/633 X |
| 5,596,795 | 1/1997 | Beisswenger | 24/633 |

*Primary Examiner*—James R. Brittain
*Attorney, Agent, or Firm*—Tarolli, Sundheim, Covell, Tummino & Szabo

[57] ABSTRACT

A safety belt buckle for insertion of a male lug designed to resist the action of a belt pretensioner, comprises a load bearing frame with a catch bolt slidingly mounted thereon and adapted to be moved between an unlocked and a locking position in which it engages the inserted male lug, a release button adapted to be operated to slide the catch bolt into its unlocked position for release of the male lug, a multiple-arm locking lever for preventing unintentional displacement of the release button, a pivot axis for the locking lever, and an inertial mass body movably mounted on the locking lever. The locking lever has a first and a second arm and being mounted on the frame for pivoting about the pivot axis. The first arm of the locking lever is pivotally coupled to the release button. Abrupt changes in velocity of the buckle in two opposite directions, appear during the belt pretensioning. The inertial mass body is so mounted in a moving manner on the second arm for transmission of its inertial force upon an abrupt change in velocity of the buckle during belt pretensioning, that during the abrupt change in velocity of the buckle in one direction the inertial mass body transmits an inertial force to the second arm and that the inertial mass body is movable with respect to the lever arm upon abrupt change of velocity in the opposite direction to interrupt the transmission of force from the inertial mass body to the lever arm. The inertial forces acting on the locking lever from the outside together with its inherent moment of inertia producing a sum moment of inertia about its pivot axis, which moment prevents an unintentional sliding of the release button during an abrupt change in velocity of the buckle during belt pretensioning.

18 Claims, 4 Drawing Sheets

SAFETY BELT DESIGNED FOR USE WITH A BELT PRETENSIONER

FIELD OF THE INVENTION

The invention relates to a safety belt buckle designed to resist the action of a belt pretensioner.

BACKGROUND OF THE INVENTION

A buckle is disclosed in the European patent publication 0 557 983 A1. One arm of the locking lever provided in this buckle is coupled to the release button, and a claw-like end of the second arm limits movement of a locking pin, which holds the catch bolt in the locking position. The unintentional unlocking of the buckle in the case of use of a belt pretensioner at the beginning or at the end of the pretensioning stroke, when inertia of the parts may lead to unlocking of the release button, is to be prevented in the following manner in the known buckle: in order to prevent unlocking of the release button during abrupt deceleration at the end of the belt pretensioning stroke, the center of gravity of the locking lever is so arranged in relation to its pivot axis that the sum of the torques about the pivot axis urges the locking lever into its locking position. Unlocking during abrupt acceleration at the beginning of the belt pretensioning stroke is to be avoided because the moment of inertia of the locking lever is so large that rotary movement is prevented or because same only leads to a small movement which does not unlock the buckle. Theoretically it is, however, never possible to exclude the possibility of acceleration forces occurring in certain exceptional circumstances which are large enough to cause a large enough movement of the locking lever for unlocking the release button. Even small unlocking movements are therefore to be prevented.

BRIEF SUMMARY OF THE INVENTION

The invention provides a buckle designed to resist the action of a belt pretensioner and in the case of which unintentional displacement of the release button is excluded during heavy acceleration and also during heavy deceleration even in exceptional circumstances. The safety belt buckle according to the invention comprises a load bearing frame with a catch bolt slidingly mounted thereon and adapted to be moved between an unlocked and a locking position in which it engages the inserted male lug, a release button adapted to be operated to slide the catch bolt into its unlocked position for release of the male lug, a multiple-arm locking lever for preventing unintentional displacement of the release button, a pivot axis for the locking lever, and an inertial mass body movably mounted on the locking lever. The locking lever has a first and a second arm and is mounted on the frame for pivoting about the pivot axis. The first arm of the locking lever is pivotally coupled to the release button. Abrupt changes in velocity of the buckle in two opposite directions, according to the acceleration at the beginning and the deceleration at the end of the belt pretensioning, appear during the belt pretensioning. The inertial mass body is so mounted in a moving manner on the second arm for transmission of its inertial force upon an abrupt change in velocity of the buckle during belt pretensioning, that during the abrupt change in velocity of the buckle in one direction the inertial mass body transmits an inertial force to the second arm and that the inertial mass body is movable with respect to the lever arm upon abrupt change of velocity in the opposite direction to interrupt the transmission of force from the inertial mass body to the lever arm. The inertial forces acting on the locking lever from the outside together with its inherent moment of inertia produce a sum moment of inertia about its pivot axis, which moment prevents an unintentional sliding of the release button during an abrupt change in velocity of the buckle during belt pretensioning.

The invention is based on the recognition that the moment of inertia of the locking lever only contributes to locking the release button during a change in velocity in one direction whereas in the opposite direction, it may even contribute to unlocking the release button. While in the known buckle the locking lever possesses a boss molded integrally on it for altering the position of the center of gravity, in the buckle of the invention a locking lever is provided with its own inertial mass body which is movingly mounted on the locking lever. Accordingly the sum moment of inertia about the pivot axis of the locking lever is of different size during acceleration and deceleration with the result that unintentional displacement of the release button may be excluded.

Preferably the inertial mass body is coupled in the one direction of the movement with the second arm and in the opposite direction is uncoupled from the second arm owing to the relative movement to the second arm so that it only exerts a part of the inertial force or preferably no inertial force at all to the second arm. Uncoupling in one direction may for instance be rendered possible by a slot provided in the inertial mass body, into which the second arm extends and which permits a relative movement in one direction. Using suitable locking mechanisms, as for instance ratchet pawls, the inertial mass body is coupled in the other direction with the second arm.

The interruption of force transmission from the inertial mass body to the locking lever is preferably caused in the case of a large change in velocity in the opposite direction owing to its relative movement toward the second arm because the inertial mass body strikes a stopper fixed to the frame and partially or preferably completely supports itself on same. Owing to such supporting action effective on the stopper the inertial mass body merely transmits a small or preferably no inertial force to the locking lever.

The inertial mass body may be mounted in a sliding fashion on the second arm for movement in translation thereon. In a preferred embodiment it is, however, mounted on the second arm for rotary motion in eccentric relationship to its center of gravity, the stopper mounted on the frame constituting a first rotary stopper for the inertial mass body. A second rotary stopper acting in the opposite direction of rotation of the inertial mass body in relation to the first rotary stopper is constituted by a section of the second arm itself, against which the inertial mass body may strike. In the locked position of the locking lever the inertial mass body engages the second rotary stopper or is at only a small distance therefrom with the result that the inertial force of the inertial mass body is transferred immediately to the locking lever, in the case of an abrupt change in velocity, in the corresponding direction.

In the case of the preferred embodiment one or both rotary stoppers are at the same level as the center of gravity of the inertial mass body as seen looking in a direction parallel to the actuation direction of the release button. For the first rotary stopper this means that the inertial mass body fully bears or is fully supported on it and the inertial mass body hence does not exert any inertial force on the locking lever. Accordingly the path for the transfer of inertial force to the locking lever is completely interrupted.

It is convenient for the interruption of force transmission from the inertial mass body to the locking lever to take place during acceleration of the buckle. The inertial force of the inertial mass body for preventing displacement of the release button consequently only acts at the end of the belt pretensioning stroke.

DETAILED DESCRIPTION OF A PREFERRED EMBODIMENT

Figure 1:
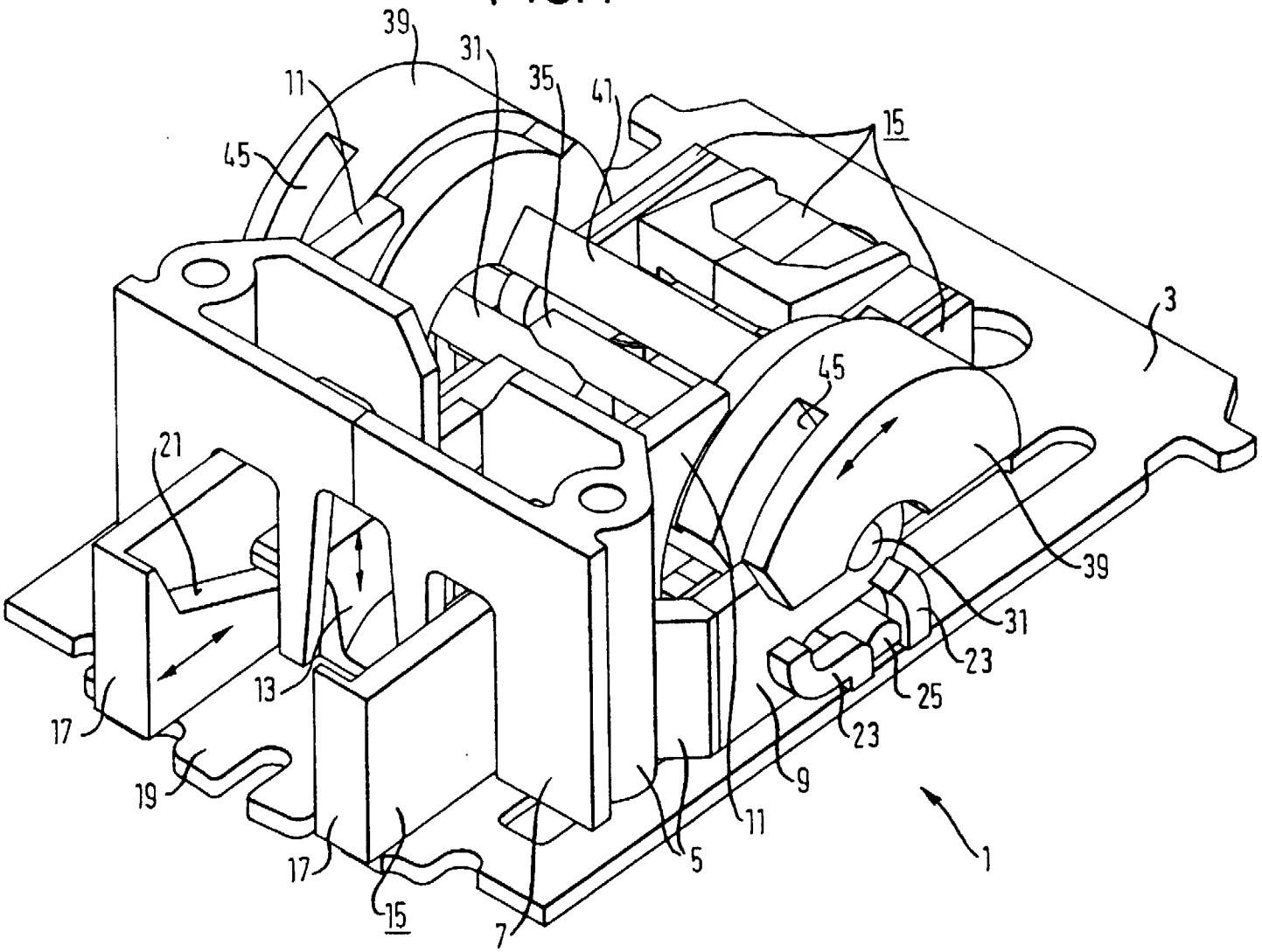
FIG. 1 shows a perspective view, with some parts cut away, of the buckle in accordance with a preferred embodiment.

In FIG. 1 the reader will see a buckle 1 resistant to a belt pretensioning action for safety belts, said buckle being attached to a fitting part, not illustrated, for a belt pretensioner, which is not shown either. The buckle 1 possesses a housing plate 3 with a load bearing frame 5 secured thereto. The frame 5 comprises, as functional components, five different parts, namely a guide block 7, a right hand longitudinal support bar 9 and a left hand bar symmetrical thereto, which is not illustrated, and furthermore a left hand and a right hand first rotary stopper 11. The hollow interior of the guide block 7 serves as a guide for a catch bolt 13 able to move perpendicularly to the housing plate 3 and which in the locking position as shown in FIG. 1 is urged downward. A release button 15, which extends between the longitudinal support bars 9 and through the guide block 7 and is mounted for sliding motion parallel to the longitudinal axis of the housing plate 3 thereon, has two parallel longitudinal ribs 17 at its end adjacent to the guide block, and between such ribs 17 a push-in path or track 19 is defined for a male lug. The release button 15 serves to shift the catch bolt 13 into its unlocked setting. When the male lug is locked in the buckle 1 the catch bolt 13 engages it, whereas in the unlocked position it frees the male lug. Ramp surfaces 21 on the inner side of each longitudinal rib 17 engage corresponding surfaces on the catch bolt 13 in order to move same upward into its unlocked position.

Figure 2:
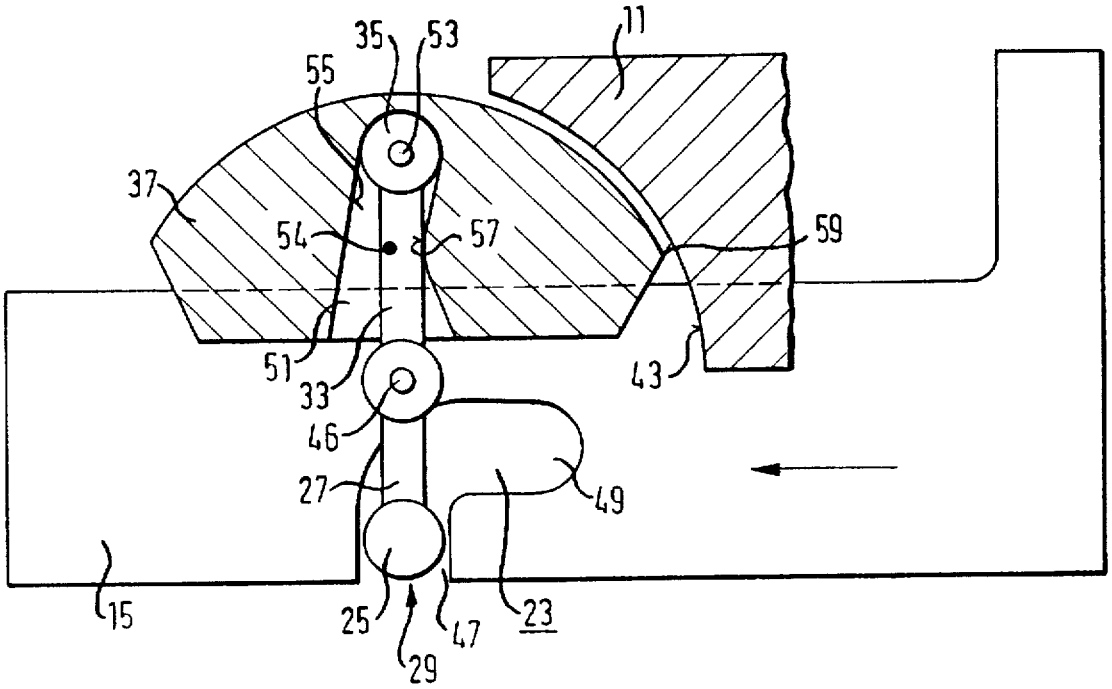
FIG. 2 is a diagrammatic side elevation of the buckle of the invention in the locked setting thereof, with reference to which the mechanical principle of the buckle is to be explained.

The release button 15 has two lateral, mutually opposite guideways of which only the right hand guideway 23 is illustrated. The guideway 23 is closed, the upper part being cut away in FIG. 1 in order to render parts behind it more readily visible. In the guideway 23 the laterally cranked, free end 25 of a first arm 27 of a two-armed locking lever 29 is pivoted, which is illustrated in more detail in FIGS. 2 through 6. The locking lever 29 is rotatably mounted by means of a projecting pin-like section 31 at its two lateral ends on the longitudinal support bars 9 and it extends practically along the entire width of the buckle 1. A second arm 33 opposite to the first arm 27, is to be seen more clearly in FIGS. 2 through 6. The free end 35 thereof extends athwart the width of the buckle 1 and serves as a rotary bearing for an inertial mass body 37. The inertial mass body 37 comprises two oppositely placed mass parts 39 and a connection rib 41. Each mass part 39 generally has the shape of a semi-cylinder, the axis of curvature of the cylindrical external surface coinciding with the pivot axis 46 of the locking lever 29. The first rotary stoppers 11 have a concavely curved surface which is adapted to the cylindrical external surface, and whose axis of curvature also coincides with the pivot axis 46 of the locking lever 29. The distance between the concave surface 43 of each first rotary stopper 11 and the associated mass part 39 is, as shown in FIG. 2, extremely small with the result that only a narrow gap is left between such parts. In a plane at a right angle to the pivot axis 46 of the locking lever 29 each mass part 39 has a guide groove 45, in which the corresponding longitudinal support bar 9 of the frame 5 fits so that there is a lateral guiding action for the mass part 39.

The further structure of the buckle 1 will now be explained with reference to FIG. 2 in more detail, individual parts being in some cases illustrated in simpler form than in FIG. 1. FIG. 2 more especially shows the pivotal connection of the locking lever 29 more clearly. The free end 25 of the first arm extends, as already mentioned, into the guideway 23 in the release button 15. The guideway 23 has two sections, namely a section 47, which runs at a right angle to the housing plate 3, and a section 49 extending in parallelism to the housing plate 3 and which merges with the section 47. In the locking position depicted in FIG. 2, in which the locking lever 29 is approximately at a right angle to the housing plate 3, the end 25 is placed in the section 47 at only a small distance from the wall.

The inertial mass body 37 has a receiving opening 51 for turningly mounting it, such opening extending for a fair depth into its interior. At the deepest point of the receiving opening 51 the form of the end 35 of the second arm 33 is rounded off with the result that the end 35 constitutes a rotary bearing for the inertial mass body 37. The center of gravity 54 of the inertial mass body 37 lies between the pivot axis 46 and the axis 53 of rotation which is set by the end 35. Two mutually opposite sections of the receiving opening 51 are formed differently. One section 55 facing the first rotary stopper 11 extends so obliquely outward that the receiving opening 51 permits rotation of the inertial mass body 37 about the axis 53 of rotation in counter-clockwise direction. The oppositely placed section on the other hand has an inwardly extending projection, which in the locking position touches the arm 33 with the result that in this part the arm 33 forms a second rotary stopper 57 for the inertial mass body 37. The second rotary stopper 57 acts in the opposite direction of turning to that of the first rotary stopper 11.

Figure 3:
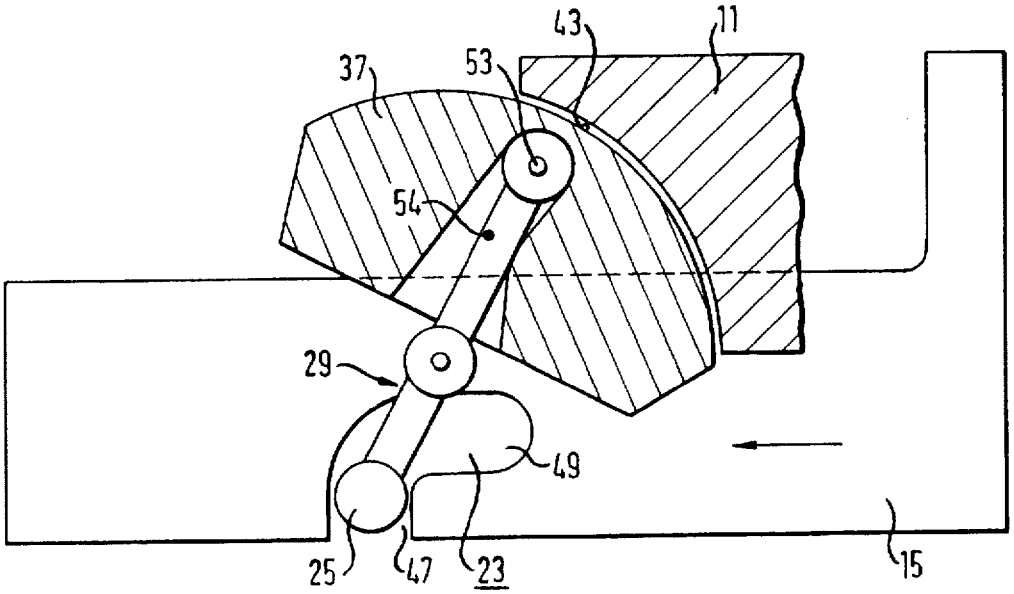
FIGS. 3 and 4 show the buckle of FIG. 2 with the release button partially and, respectively, completely depressed.
Figure 4:
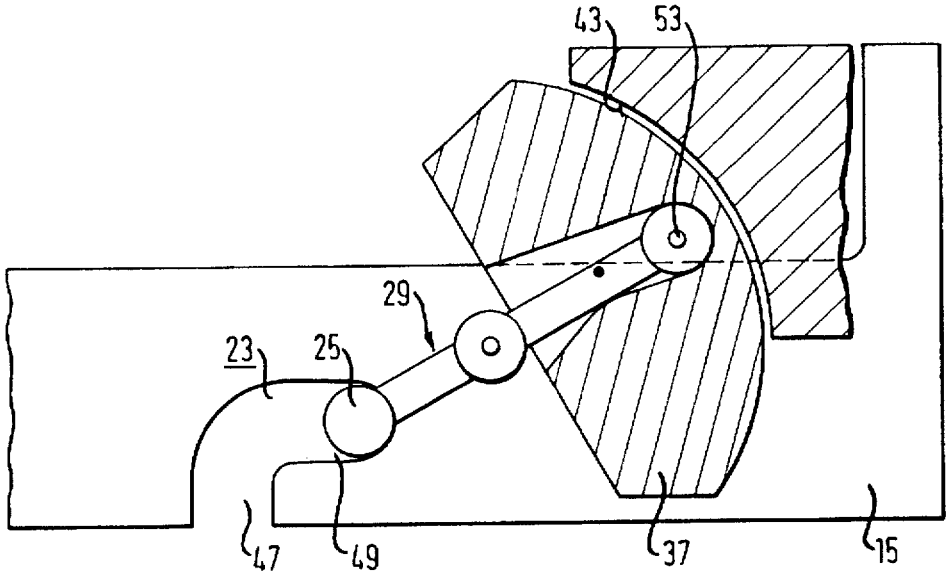

For shifting the catch bolt 13 into its unlocked position the release button 15 must be depressed as indicated by the arrow of FIG. 2. Owing to the small lateral distance between the end 25 and the wall adjacent to the section 47 even a slight displacement of the release button 15 will cause the locking lever 29 to be pivoted clockwise until, as shown in FIG. 3, it is relatively oblique and finally, as shown in FIG. 4, the end 25 is located on the end of the section 49 of the guideway 23. Owing to its center 54 of gravity being eccentric in relation to the axis 53 of rotation, the inertial mass body 37 is turned counter-clockwise to a small extent till it contacts the surface 43, but, however, the cylindrical external surface of the inertial mass body 37 will slide on the correspondingly shaped surface 43.

Figure 5:
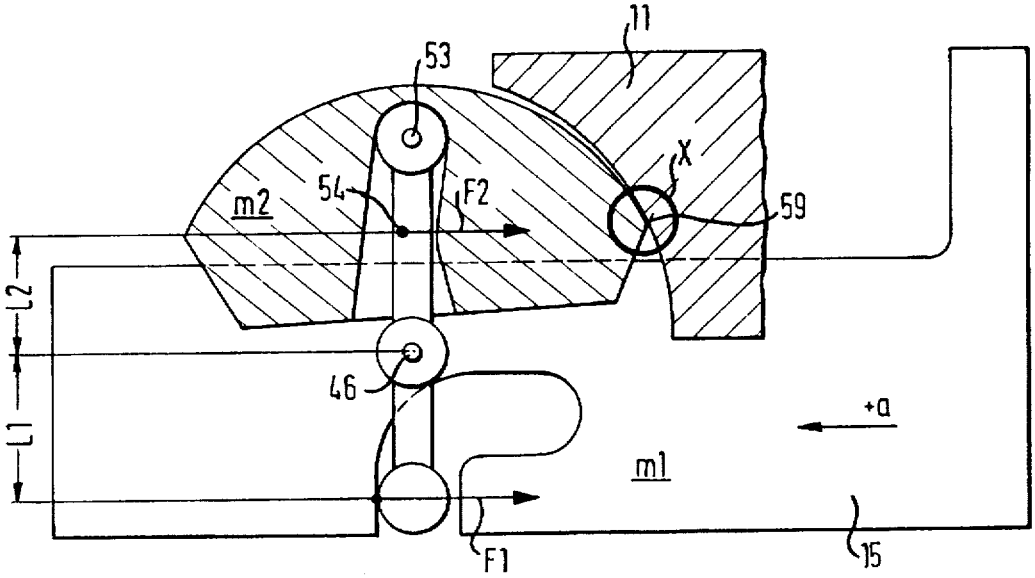
FIG. 5 shows the buckle in accordance with FIG. 2 during abrupt acceleration at the beginning of the belt pretensioning stroke.

In FIG. 5 the movements of the parts in relation to each other during acceleration in the direction of the arrow at the start of belt pretensioning are illustrated. Owing to its inertia the release button 15 acts so that one lever arm L1 thereof is thrust to the right of the pivot axis 46. The center of gravity of the locking lever 39 is generally at the same level as the pivot axis 46 so that it does not produce any torque because of its inertia. On the other hand the inertia of the relatively heavy inertial mass body 37 leads to a force F2. This force would produce a torque in the locking lever 29 which would be sufficiently large to thrust the release button 15 to the left into the unlocked position. Since the inertial mass body 37 is, however, eccentrically mounted for rotation, it will pivot about its axis 53 of rotation counterclockwise, and its external surface will immediately strike the second rotary stopper 11. Since the portion marked X of the stopper 11 is generally at the same level as the center of gravity 54, the inertial mass body 37 will bear fully against the second rotary stopper 11 so that it will not transmit any force to the locking lever 29. The release button 15 may accordingly not be caused to move by the locking lever 29. An alternatively provided minimum idle stroke between the first arm and the left wall of the section 47 may be employed to ensure that at the beginning of rotation of the inertial mass body 37 any slight force transmitted to the locking lever 39 does not lead to shift of the release button 15. The inertial mass body 37 is angled on its cylindrical external surface at the level of the center of gravity. Accordingly there is a locking edge 59, which extends in parallelism to the pivot axis 46 and to the axis 53 of rotation. If this locking edge 59 is made relatively sharp and the inertial mass body 37 strikes against the surface 43 in the course of acceleration as indicated in FIG. 5, it is possible for the locking edge 59 to additionally prevent sliding of the surface of the inertial mass body 37 on the surface 43 when the surfaces come together.

Figure 6:
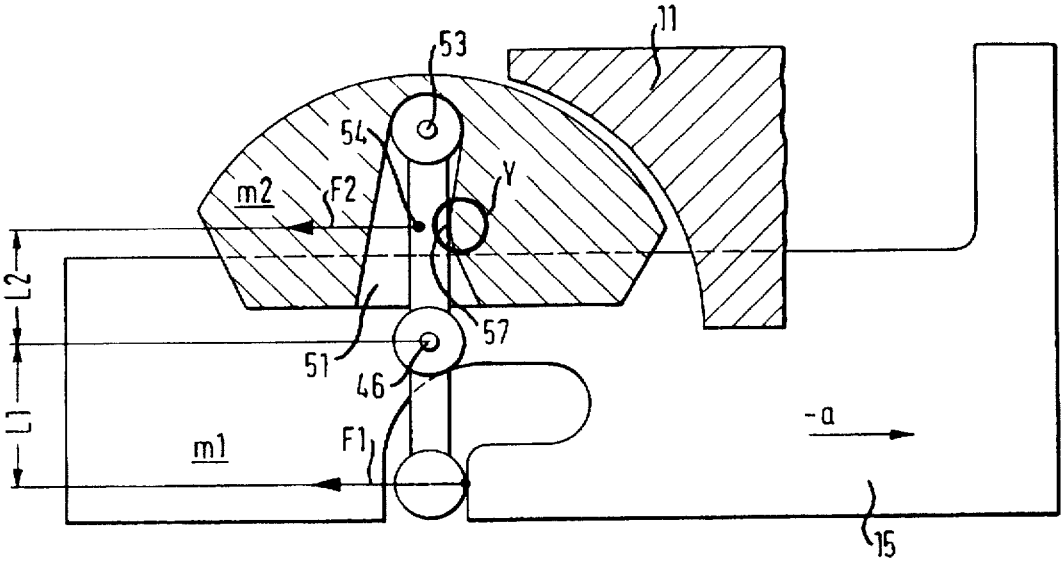
FIG. 6 shows the buckle in accordance with FIG. 2 during abrupt deceleration at the end of the belt pretensioning stroke.

FIG. 6 shows the relationship between the forces on the buckle 1 at the end of the belt pretensioning stroke, when the buckle 1 is suddenly retarded so that there is deceleration as indicated by the arrow. Only the second rotary stopper 57 and not the first rotary stopper 11 acts during such deceleration. Owing to its inertia, the inertial mass body 37 turns clockwise and, if it is not already in the locking position on the second rotary stopper 57, will abut against same after a minimum pivotal movement (see the portion denoted as Y). The inertial mass body 37 and the locking lever 29 are connected together in this direction of motion for the transmission of forces. Accordingly one lever arm L2 will transmit a force F2 to the locking lever 29. The corresponding torque due to the heavy inertial mass body 37 about the pivot axis 46 is substantially larger than the torque transferred by the inertial mass of the release button 15 to the locking lever 29, same being overcompensated by the inertial mass body 37. Accordingly the inertial mass body 37 always prevents unintentional displacement of the release button 15.

The buckle illustrated herein is protected against displacement of the release button 15 owing to abrupt changes in velocity during movement of the two opposite directions.

I claim:

1. A safety belt buckle for insertion of a male lug designed to resist the action of a belt pretensioner, comprising a load bearing frame with a catch bolt slidingly mounted thereon and adapted to be moved between an unlocked and a locking position in which it engages said inserted male lug, a release button adapted to be operated to slide said catch bolt into its unlocked position for release of said male lug, a multiple-arm locking lever for preventing unintentional displacement of said release button, a pivot axis for said locking lever, and an inertial mass body movably mounted on said locking lever, said locking lever having a first and a second arm and being mounted on said frame for pivoting about said pivot axis, said first arm of said locking lever being pivotally coupled to said release button, abrupt changes in velocity of said buckle in two opposite directions, appearing during the belt pretensioning, said inertial mass body being so mounted in a moving manner on said second arm for transmission of its inertial force upon an abrupt change in velocity of said buckle during belt pretensioning, that during said abrupt change in velocity of said buckle in one direction said inertial mass body transmits an inertial force to said second arm and that said inertial mass body is movable with respect to said lever arm upon abrupt change of velocity in said opposite direction to interrupt the transmission of force from said inertial mass body to said lever arm, and said inertial forces acting on said locking lever from the outside together with its inherent moment of inertia producing a sum moment of inertia about its pivot axis, which moment prevents an unintentional sliding of said release button during an abrupt change in velocity of said buckle during belt pretensioning.

2. The buckle as claimed in claim 1, wherein said inertial mass body is coupled with said second arm in one direction on said abrupt change in the velocity and is uncoupled from same in the opposite direction owing to motion in relation to said second arm and only transmits at the most a part of said inertial force to said locking lever.

3. The buckle as claimed in claim 1, wherein a stopper fixed to said frame is provided against which said inertial mass body abuts upon an abrupt change in velocity owing to its motion in relation to said second arm which at least partially supports said mass body with the result that the transmission of force to said second arm is at least substantially interrupted.

4. The buckle as claimed in claim 3, wherein said inertial mass body has a center of gravity and is mounted in a rotatable manner on said second arm eccentrically to its center of gravity and wherein said stopper fixed to said frame constitutes a first rotary stopper.

5. The buckle as claimed in claim 4, wherein a second rotary stopper acting relatively to the first one in the opposite direction of rotation of said inertial mass body is provided and is formed by a section of said second arm, against which said inertial mass body may strike.

6. The buckle as claimed in claim 5, wherein said inertial mass body abuts said second rotary stopper in said locking position of said locking lever.

7. The buckle as claimed in claim 5, wherein said inertial mass body is at only a small distance from said second rotary stopper in said locking position of said locking lever.

8. The buckle as claimed in claim 5, wherein said second arm has a free end and wherein said inertial mass body has a receiving opening for movingly mounting it and at the deepest point thereof abuts against said free end of said second arm, one section of said receiving opening being able to strike against said second rotary stopper.

9. The buckle as claimed in claim 5, wherein at least one of said rotary stoppers, as seen looking in a direction parallel to the actuation direction of said release button, is at the same level as said center of gravity of said inertial mass body.

10. The buckle as claimed in claim 9, wherein said inertial mass body has a locking edge on its outer surface at the level of its center of gravity for engagement of said inertial mass body on said first rotary stopper.

11. The buckle as claimed in claim 4, wherein said first rotary stopper has a surface serving for stopping said inertial mass body, said surface having a circular arc, concave cross section, the center point of curvature of which being on said pivot axis of said locking lever.

12. The buckle as claimed in claim 11, wherein said inertial mass body has in part an outer surface which in section is circularly arcuate and convex, such surface being a small distance from said surface of said first rotary stopper and having its center of curvature on said pivot axis of said locking lever.

13. The buckle as claimed in claim 4, wherein said inertial mass body has at least one guide groove extending in a plane perpendicular to said pivot axis of said locking lever, and wherein said frame having a longitudinal support bar extending in such guide groove.

14. The buckle as claimed in claim 4, wherein said inertial mass body comprises two mass parts arranged laterally on said buckle and a connecting rib, and wherein each mass part has rotary stoppers associated with it.

15. The buckle as claimed in claim 1, wherein said inertial mass body is slidingly mounted on said two-armed lever for movement in translation.

16. The buckle as claimed in claim 1, wherein said interruption of force transmission from said inertial mass body to said locking lever takes place on acceleration of said buckle at the beginning of a belt pretensioning stroke.

17. The buckle as claimed in claim 1, wherein a push-in path is provided and wherein said catch bolt is guided for movement at a right angle to said push-in path for said male lug in said frame.

18. The buckle as claimed in claim 1, wherein a guideway is provided and said first arm of said locking lever is pivotally connected to said release button by said guideway.

* * * * *

UNITED STATES PATENT AND TRADEMARK OFFICE

CERTIFICATE OF CORRECTION

PATENT NO : 5,765,266

DATED : June 16, 1998

INVENTOR(S) : Hans-Peter Betz

It is certified that error appears in the above-identified patent and that said Letters Patent is hereby corrected as shown below:

Col. 6, line 10
replace "directions,"
with --directions--.

Signed and Sealed this

Twenty-fifth Day of May, 1999

*Attest:*

Q. TODD DICKINSON

*Attesting Officer*

*Acting Commissioner of Patents and Trademarks*